US006324361B1

(12) United States Patent
Itoh et al.

(10) Patent No.: US 6,324,361 B1
(45) Date of Patent: Nov. 27, 2001

(54) COOLING UNIT AND METHOD OF COOLING AN ELECTROPHOTOGRAPHIC APPARATUS

(75) Inventors: Fumihiro Itoh; Takeo Kojima; Yoshihiro Watanabe, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/564,470

(22) Filed: May 3, 2000

(30) Foreign Application Priority Data

Oct. 21, 1999 (JP) ..... 11-299334

(51) Int. Cl.[7] ..... G03G 21/20
(52) U.S. Cl. ..... 399/92
(58) Field of Search ..... 399/92, 94, 320, 399/33, 43, 69, 70, 330, 332; 219/216

(56) References Cited

U.S. PATENT DOCUMENTS 5,647,727 * 7/1997 Taniguchi et al. ..... 417/32
5,666,187 * 9/1997 Kim ..... 355/30
5,819,136 * 10/1998 Tomita et al. ..... 399/69
5,920,749 * 7/1999 Sugaya et al. ..... 399/69

FOREIGN PATENT DOCUMENTS 62-148986 * 7/1987 (JP) .
63-159873 * 7/1988 (JP) .
63-301063 * 12/1988 (JP) .
04-084309 * 3/1992 (JP) .
04-250473 * 9/1992 (JP) .
04-316061 * 11/1992 (JP) .

* cited by examiner

*Primary Examiner*—Robert Beatty
(74) *Attorney, Agent, or Firm*—Armstrong, Westerman, Hattori, McLeland & Naughton, LLP

(57) ABSTRACT

The ratio detecting unit detects, upon stoppage of printing, a fixing control ratio K which represents a ratio of time during which the fixing unit was controlled to the printing temperature in a certain period of time in the past. The predicting unit predicts a fan driving time Tf after stoppage of printing in response to the thus detected fixing control ratio K. The fan control unit rotation-controls the cooling fan 42 during printing, keeps the fan controlling status for printing for a fan driving time Tf upon stoppage of printing, and upon lapse of the fan driving time Tf, fan stoppage or high-speed rotation is switched over to low-speed rotation.

8 Claims, 9 Drawing Sheets

77

| FIXING CONTROL RATIO K | FAN DRIVING TIME Tf |
|---|---|
| 0% < K ≦ 25% | 2. 5MIN |
| 25% < K ≦ 50% | 5. 0MIN |
| 50% < K ≦ 75% | 7. 5MIN |
| 75% < K ≦ 100% | 10. 0MIN |

FIG. 5A

77

| FIXING CONTROL RATIO K | FAN DRIVING TIME Tf |
|---|---|
| 0% < K ≦ 25% | Tf0 |
| 25% < K ≦ 50% | Tf1 |
| 50% < K ≦ 75% | Tf2 |
| 75% < K ≦ 100% | Tf3 |

FIG. 5B

77

| FIXING CONTROL RATIO K | FAN DRIVING TIME Tf |
|---|---|
| 0% < K ≦ 25% | 2. 5MIN |
| 25% < K ≦ 50% | 5. 0MIN |
| 50% < K ≦ 75% | 7. 5MIN |
| 75% < K ≦ 100% | 10. 0MIN |

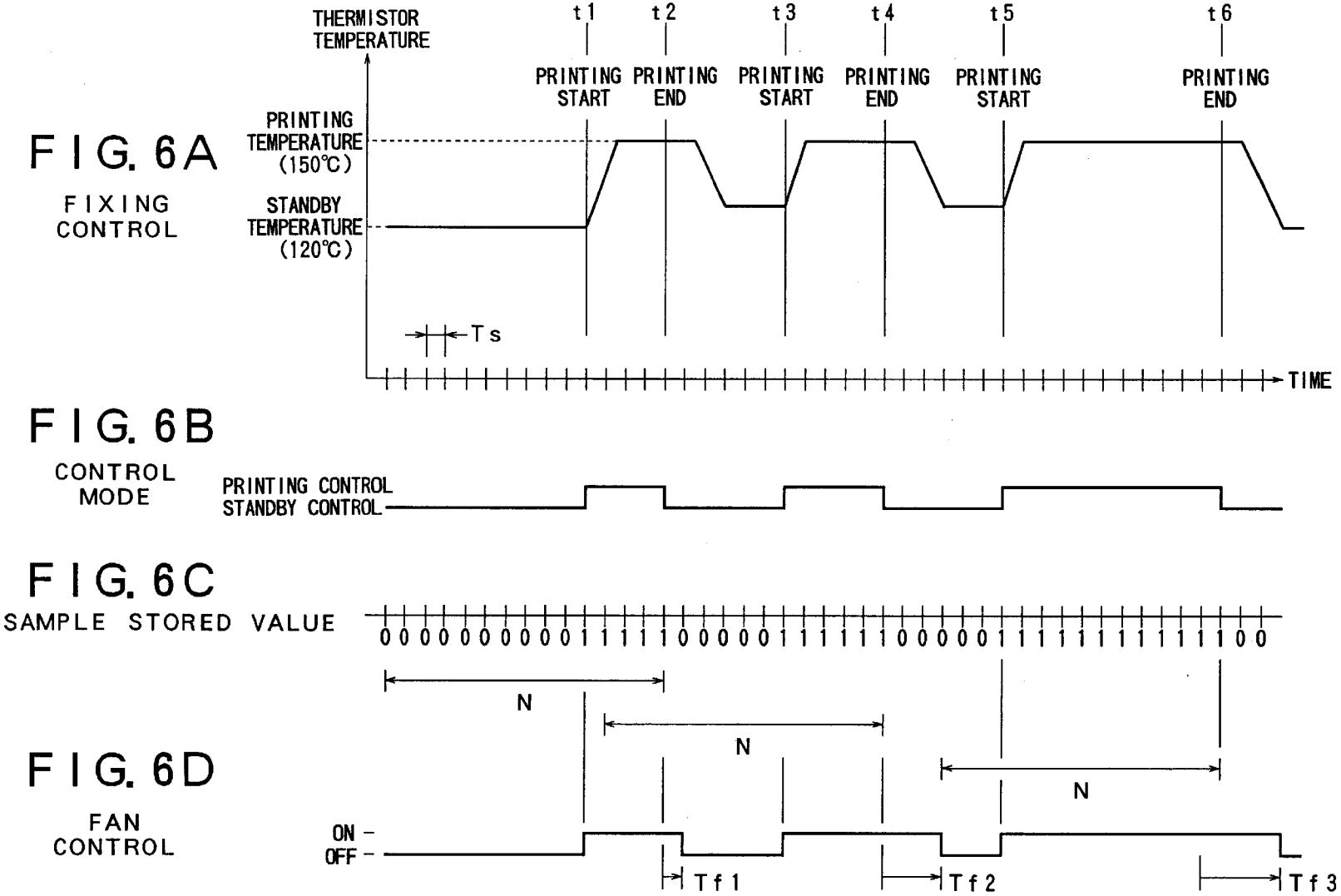
FIG. 6A FIXING CONTROL
FIG. 6B CONTROL MODE
FIG. 6C SAMPLE STORED VALUE
FIG. 6D FAN CONTROL

COOLING UNIT AND METHOD OF COOLING AN ELECTROPHOTOGRAPHIC APPARATUS

BACKGROUND OF THE INVENTION

1. Field of the Invention

The present invention relates to a cooling control unit and a method therefore for an electrophotographic apparatus, which fixed toner onto a sheet of paper during printing by controlling temperature to a printing temperature, and upon stoppage, cools an increase in temperature caused by a fixing unit and the like. More particularly, the invention relates to a cooling control unit and a method therefor for an electrophotographic apparatus, which controls a cooling fan by predicting an increase in temperature from the control status of the fixing unit without the need for a temperature sensor.

2. Description of the Related Arts

In a conventional electrophotographic apparatus such as a laser printer, provided with an apparatus cooling fan, toner is fixed on a sheet of paper by temperature-controlling a heater of a fixing unit. The fixing unit is controlled to a printing temperature of, for example, 150° C. during printing, and to a standby temperature of, for example, 120° C. during stoppage of printing. A cooling fan is therefore provided for the purpose of inhibiting an increase in machine internal temperature of the electrophotographic apparatus. The cooling fan is forcedly cooled through circulation of air under rotational control during printing. In a printing standby state of waiting printing, however, various motors for printing control are not driven, the cooling fan left to be driven only shows up wind howls. The wind howls may be prevented by discontinuing driving of the fan during stoppage of printing. Immediately after end of printing operation, however, the heat from heat generating components such as the heater of the fixing unit during printing causes an increase in the machine internal temperature. As a result, when fan driving is discontinued with stoppage of printing, there occurs an overshoot in which the machine internal temperature in creases over a safety temperature range, and the increase in temperature may cause occurrence of toner blocking or breakage of electric parts. In order to avoid this inconvenience, it is necessary to keep driving the fan for a certain period of time after stoppage of printing, or continue fan driving until the machine internal temperature is reduced to a safe level by providing a machine internal temperature sensor.

However, in a configuration in which the fan is driven for a certain period of time after stoppage of printing, it is necessary to drive the fan for the certain period of time even when the period of printing operation is short and the machine internal temperature is not so high, and during this certain period, occurrence of noise caused by extra fan driving poses a problem. In a configuration in which fan driving is continued until the machine internal temperature decreases to a safe level by providing an internal temperature sensor, the timing to stop the fan can be accurately known, but it is necessary to install the temperature sensor in the apparatus, thus leading to problem of a complicated apparatus configuration and a higher cost.

SUMMARY OF THE INVENTION

According to the present invention, there are provided a cooling control unit for an electrophotographic apparatus and a method therefor which can inhibit an increase in temperature after stoppage of printing without fail with minimum necessary driving of a cooling fan without the need for a temperature sensor.

The invention relates to an electrophotographic apparatus comprising a fixing unit, of which the temperature in controlled to prescribed printing temperature by a heater during printing to fix toner to a sheet of paper, and controlled to a prescribed standby temperature during stoppage; and a cooling fan rotation-controlled to prevent increase in the machine internal temperature. The invention provides a cooling control unit for such an electrophotographic apparatus comprising a ratio detecting unit which detects, during stoppage of printing, a fixing control ratio representing a ratio of time during which the fixing unit is controlled to the printing temperature for a certain period of time in the past; a predicting unit which predicts a fan driving time after stoppage of printing in response to the fixing control ratio; and a cooling fan control unit which rotation-controls a cooling fan during printing, and upon stoppage of printing, keeps a fan control status of printing during the prescribed period of time. The predicting unit predicts a fan driving time after stoppage of printing increasing substantially in proportion to the fixing control ratio K. The cooling fan control unit rotates the cooling fan at a prescribed speed, and upon stoppage of printing, stop the cooling fan after rotating the same for the predicted time. The cooling fan control unit may rotate the cooling fan at a high speed during printing, and upon stoppage of printing, may keep high-speed rotation of the cooling fan for the predicted time and then the rotation may be switched over to low-speed rotation. In the invention, as described above, the time of fan stoppage from the end of printing or switching to low-speed fan rotation is determined by predicting an increase in machine internal temperature at the end of printing on the basis of the fixing control ratio which represent the ratio of time during which the fixing unit was at the printing temperature for printing during a certain period of time in the past. More specifically since a larger fixing control ratio most probably leads to a large increase in machine internal temperature, fan operation is continued for a rather long period of time from stoppage of printing. In contrast, because a small fixing control ratio leads to small increase in machine internal temperature, fan operation is carried out for a shorter period of time from stoppage of printing. It is thus possible to keep the machine internal temperature after stoppage of printing at a safe level of temperature without the need for a sensor, minimize the driving time of the fan, and reduce noise during standby and avoid an excessive power consumption.

Further, the invention provides a cooling control method of an electrophotographic apparatus having a fixing unit, of which the temperature is controlled by a heater to a prescribed printing temperature during printing to fix toner on a sheet of paper, and upon stoppage of printing, controlled to a prescribed standby temperature, and a cooling fan rotation-controlled to prevent increase in the machine internal temperature; the method comprising the steps of:

- detecting, during stoppage of printing, a fixing control ratio representing a ratio of time during which the fixing unit is controlled to a printing temperature in a certain period of time in the past;
- predicting a fan driving time after stoppage of printing in response to the fixing control ratio; and
- rotation-controlling the cooling fan during printing, and upon stoppage of printing, keeping a fan control status for printing during the predicted time.

Details of this cooling control method are basically the same as those of the apparatus configuration.

The above and other object, features, and advantages of the present invention will become more apparatus from the following detailed description with reference to the drawings.

BRIEF DESCRIPTION OF THE DRAWINGS

FIGS. 5A and 5B are explanatory views of a conversion table which converts a fixing control ratio into a fan driving time in FIG. 4;

FIGS. 6A and 6D are time charts of cooling fan control in the embodiment shown in FIG. 4;

DETAILED DESCRIPTION OF THE PREFERRED EMBODIMENTS

Figure 1:
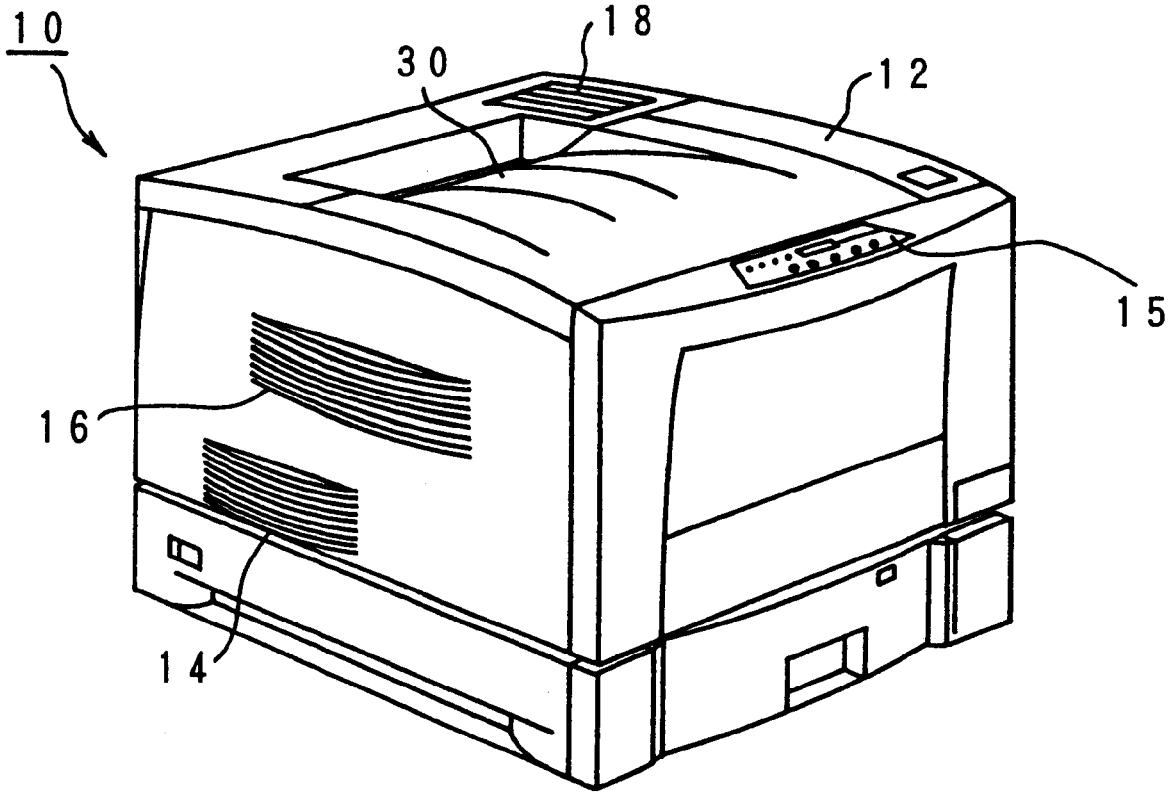
FIG. 1 is an explanatory view of a printer apparatus as an electrophotographic apparatus to which the present invention is applicable.

FIG. 1 is an explanatory view of a printer unit as an electrophotographic apparatus to which the cooling fan control unit of the present invention is applicable. The printer unit 1 has an image forming function capable of full-color printing, and can perform full-color image printing by means of four incorporation print assemblies of Y (yellow), M (magenta), C (cyan) and B (black). It is also possible to carry out monochromatic printing by operation of the B (black) print assembly alone. This printer unit 10 has a cooling fan incorporated in a frame 12. Air is introduced through two suction inlet ports 14 and 16 formed on a side surface of the frame 12 by rotational control of the cooling fan, and discharged through an outlet port 18 opening into an upper structure via the interior of the unit. An operation panel 15 is provided on this side of the upper portion of the frame 12, and a stacker 30 discharging printed sheets of paper is formed in the depth of the operation panel 15.

Figure 2:
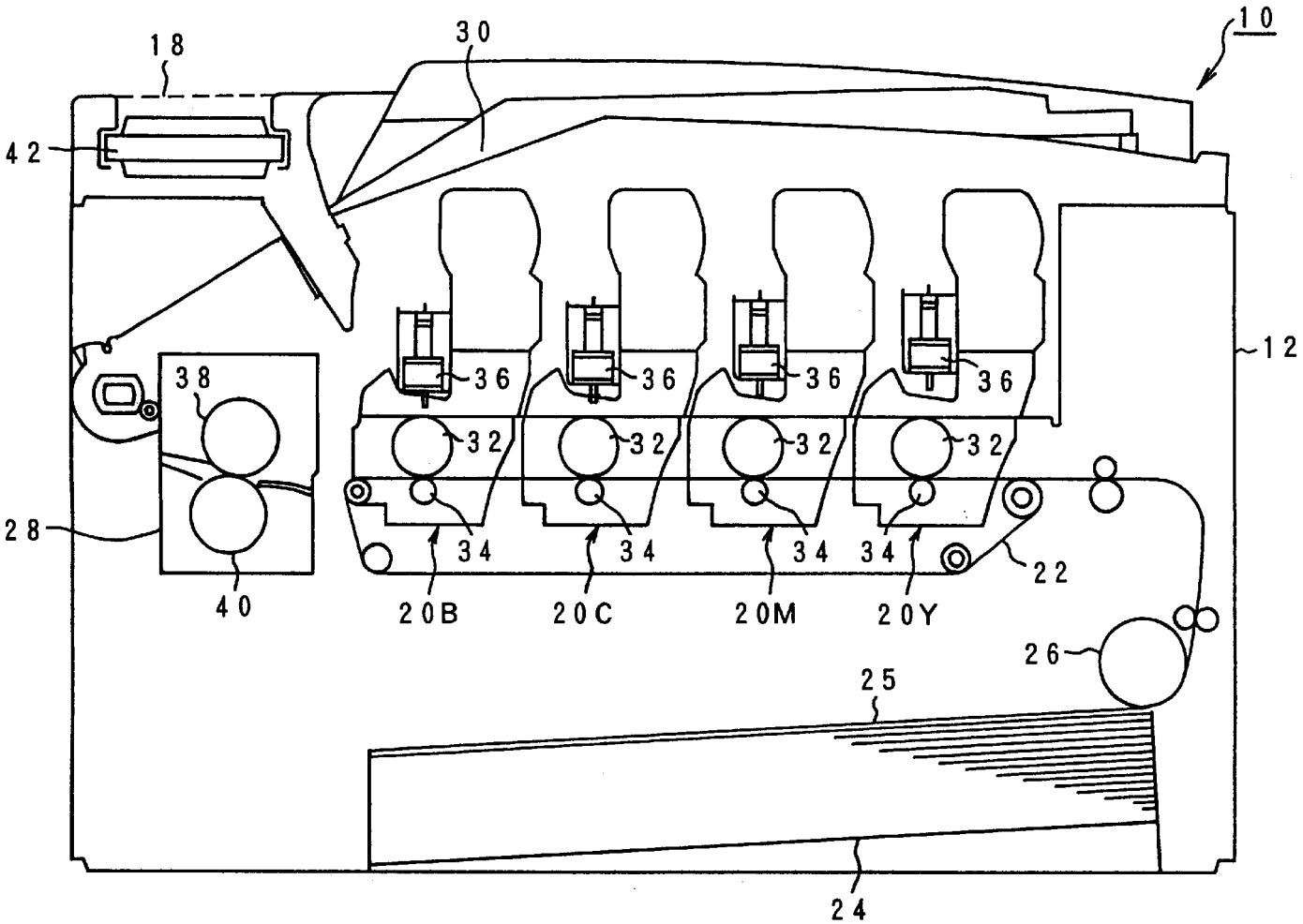
FIG. 2 is an explanatory view of the internal structure of the apparatus shown in FIG. 1.

FIG. 2 is an explanatory view of the internal structure of the printer unit 10 shown in FIG. 1. In the printer unit 10, four print assemblies 20B, 20C, 20M and 20Y conducting electrophotographic printing of color components including B component, C component, M component and Y component are arranged in series along a paper sending belt 22 composed as an endless belt. A hopper 24 is provided under the paper sending belt 22 to accumulate bundles of sheets of paper 25. The sheets of paper 25 housed in the hopper 24 are drawn out one by one by a pickup roller 26 and fed to the paper sending belt 22 by a plurality of paper feed rollers. Characters or a picture is printed on the sheets of paper fed to the paper sending belt 22 printing function of electrostatic photography in the sequence of the print assemblies 20Y, 20M, 20C and then 20B into a toner image which recorded, and the sheet already recording the toner image is sent to a fixing unit 28. The fixing unit 28 has an upper heat roller 38 and a lower heat roller 40, and fixes the toner onto the sheet by causing the sheet to pass in a state in which the fixing temperature is controlled to a prescribed printing temperature by heating with a heater in the rollers. The sheet having passed through the fixing unit 28 is guided upward by a guide and discharged into a stacker 30. The print assemblies 20Y, 20M, 20C and 20B have identical structures and are different from each other in that developing agents are a yellow toner component, a magenta toner component, a cyan toner component and a black toner component, respectively. Therefore, the print assemblies 20Y, 20M 20C and 20B transfer a yellow toner image, a magenta toner image, a cyan toner image and a black toner image in superposition onto the sheet of paper moving while being held on the paper sending belt 22, thus forming a full-color toner image. With a view to achieving a recording function as an electrophotographic apparatus, a photosensitive drum 32, a transfer roller 34, and an LED beam scanner 36 serving as an optical head are provided on each of the print assemblies 20Y, 20M, 20C and 20B. In an actual apparatus, a pre-charger, an LED beam scanner 36, a developing unit, the transfer roller 34 and a toner cleaner are arranged in the sequence around the photosensitive drum 32. In this embodiment, however, only the photosensitive drum 32, the transfer roller 34 and the LED beam scanner 36 are shown to simplify explanation. The electrophotographic recording with these print assemblies 20Y, 20M, 20C and 20B is as follows. The LED beam scanner 36 is caused to blink on the basis of image data (monochromatic or multi-valued) transferred from a host such as a personal computer or a wordprocessor, and as a result, an electrostatic latent image is written on the photosensitive drum 32 in the form of a dot image. The electrostatic latent image written on the photosensitive drum 32 is developed electrostatically into an electrostatic toner image by prescribed color toners of a developing unit (not shown). Then, the electrostatic toner image is electrostatically transferred by the transfer roller 34 located under the photosensitive drum 32 onto the sheet of paper sent on the paper sending belt 22. That is, a charge of a polarity reverse to that of the electrostatic toner image is given to the sheet sent on the paper sending belt 22, thereby electrostatically transferring the electrostatic toner image on the photosensitive drum 32 onto the sheet. The surface of the photosensitive drum 32 having completed the transfer to the sheet has residual toner. The residual toner is removed by a toner cleaner (not shown). The removed residual toner is sent back to the developing unit by a toner reflux unit and used again as developing toner. A cooling fan 42 is provided on the inside of an outlet port 18 formed at the upper left corner of the frame 12 of the printer unit 10. A cooling fan 42 having a structure in which a motor and a fan are integrally house in a housing is applicable. As to details of the printer unit 10 shown in FIG. 2, for example, the one disclosed in Japanese Unexamined Patent Publication No. 11-153893 can be used. As a printer unit 10 to which cooling control of the invention shown in FIG. 2,a suitable one is the Full-Color Page Printer GL-8300A made by Fujitsu Limited.

Figure 3A:
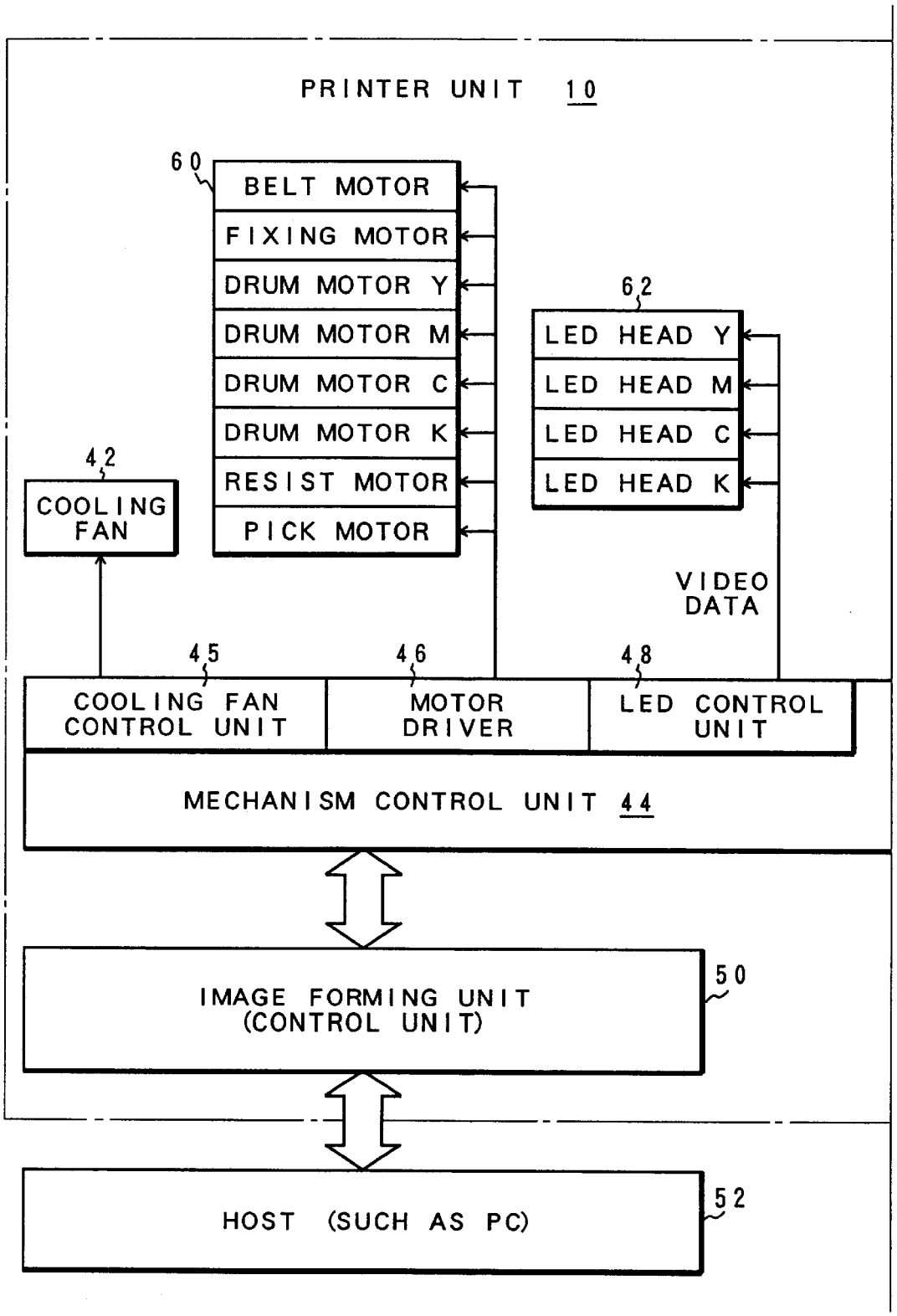
FIGS. 3A and 3B are block diagrams of the printer apparatus shown in FIG. 1.
Figure 3B:
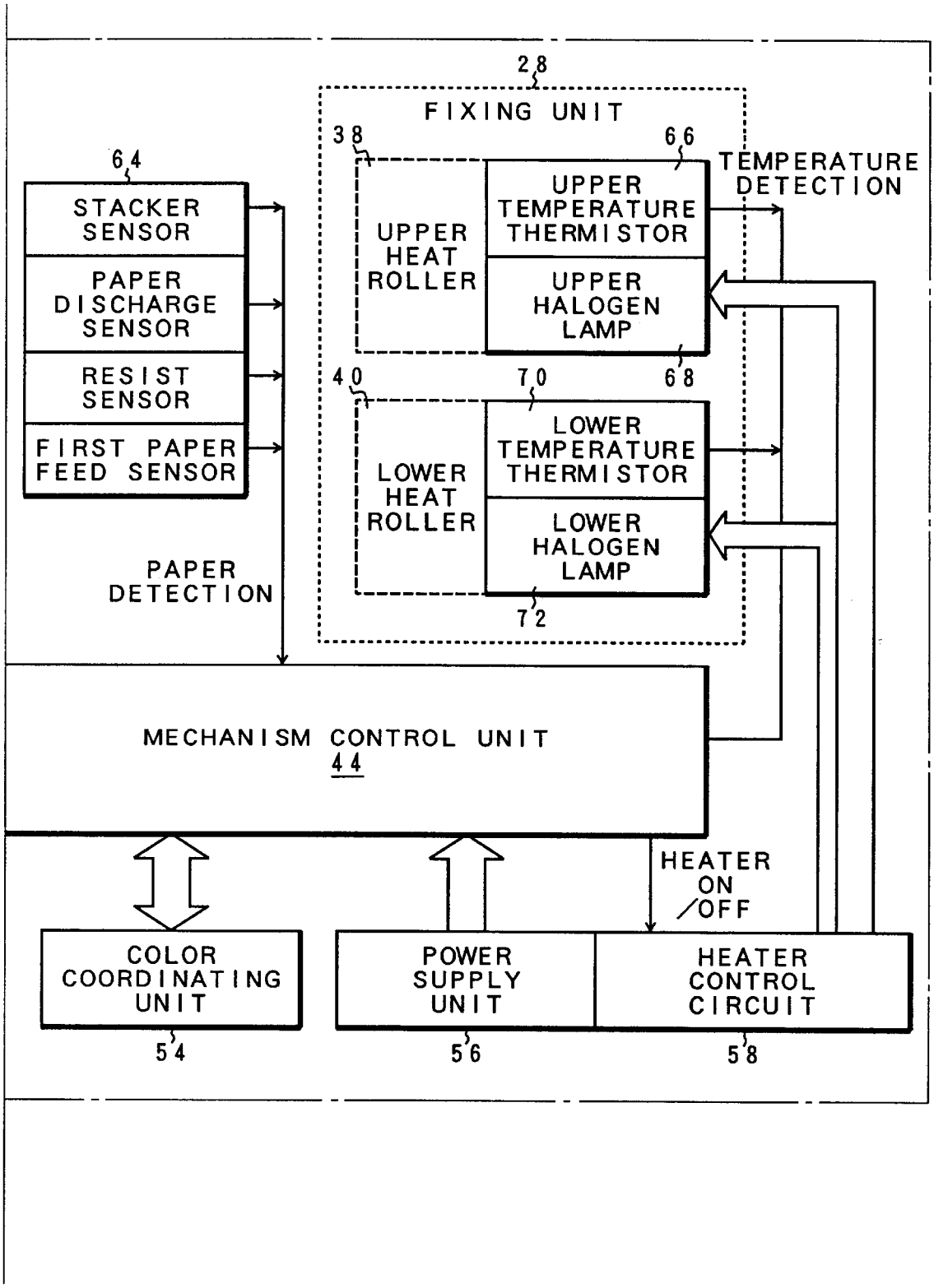

FIGS. 3A and 3B are block diagrams of the control function of the printer unit 10 shown in FIG. 1. A mechanism control unit 44 serving as a printer engine is provided in the printer unit 10. In the mechanism control unit 44, there are provided a cooling fan control unit 45 which achieves cooling control of the invention, a motor driver 46 which controls various motor units 60 and an LED control unit 48 which controls an LED head group 62 composed of LED beam scanners 22 provided on each of the print assemblies 20Y, 20M, 20C and 20B shown in FIG. 2. Further, a sensor group 64 for detecting a sheet of paper including a stacker sensor, a paper discharge sensor, a resist sensor and a fast paper feed sensor is connected to the mechanism control unit 44. Print data are given by an image forming unit 50 to the mechanism control unit 44. Image or character data are transferred from a host 52 such as an external personal computer to the image forming unit 50, which prepares print data necessary for monochromatic mode or full-color mode printing and transfers such print data to the mechanism control unit 44. A color coordinating unit 54 is provided in the mechanism control unit 44. Upon starting up the power supply of the printer unit 10, the color coordinating unit 54 transfers a transfer pattern using Y, M, C and B toner components onto the paper sending belt and detects the same with a sensor to corrects color shifts of the Y, M, C and B components. Further, there is provided a heater control circuit 58 for fixing control of the fixing unit 28. The fixing unit 28 is provided with an upper heat roller 38 and a lower heat roller 40 incorporating heaters. The heater control circuit 58 controls the transfer temperature to a prescribed printing temperature of, for example, 150° C. during printing, and in the standby state during stoppage of printing to a lower standby temperature of 120 C. An upper temperature thermistor 66 detecting temperature of the upper heat roller 38 and an upper halogen lamp 68 are provided in the fixing unit 28. A lower temperature thermistor 70 detecting temperature of the lower heat roller 40 and a lower halogen lamp 72 are provided in the lower heat roller 40.

Figure 4:
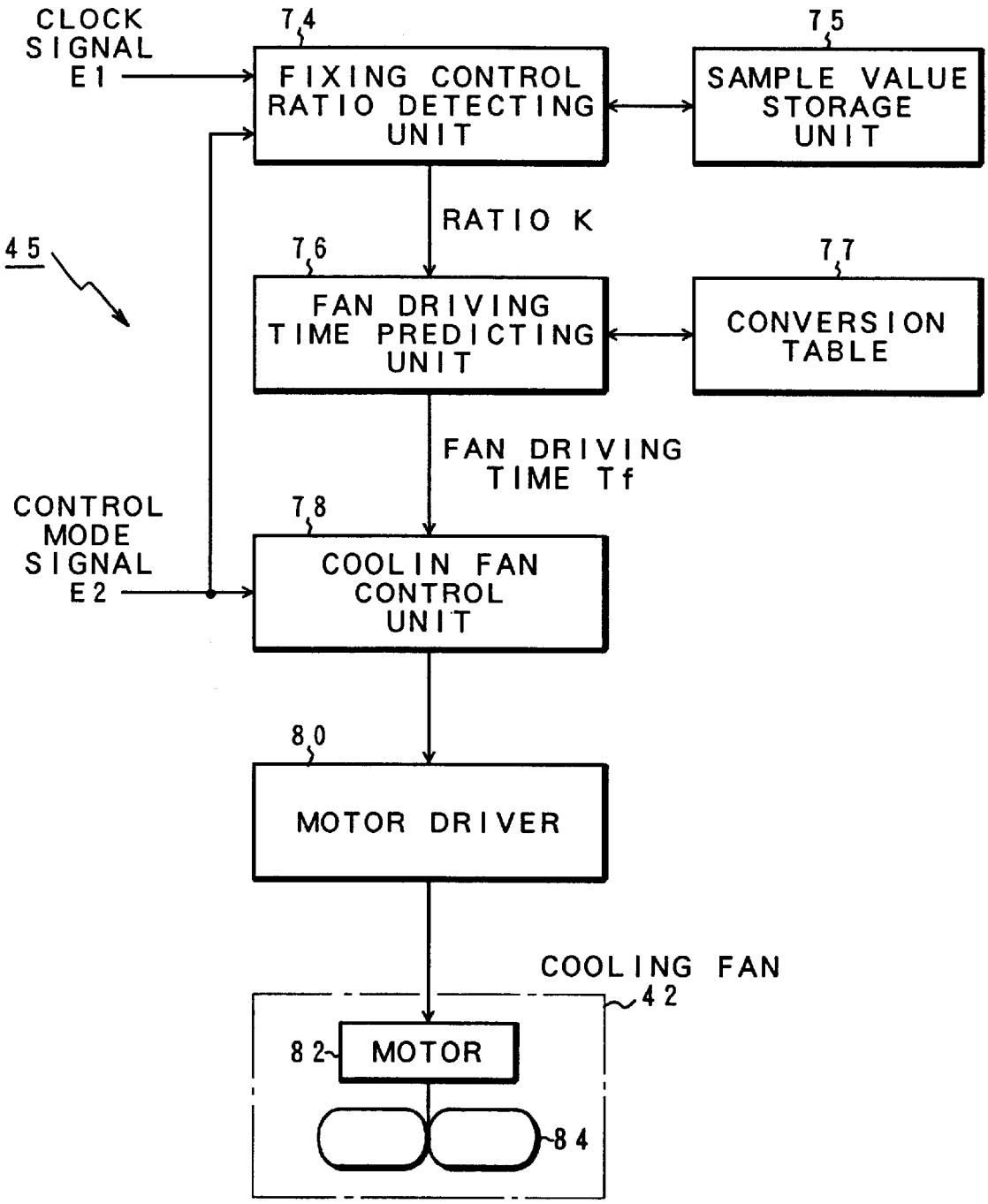
FIG. 4 is a functional block diagram of the cooling control unit of the invention provided as a cooling fan control unit in the apparatus shown in FIGS. 3A and 3B.

FIG. 4 is a functional block diagram of a cooling fan control unit 45 provided in the printer unit 10 shown in FIGS. 3A and 3B, which represents an embodiment of the cooling control unit of the invention. The cooling fan control unit 45 comprises a fixing control ratio detecting unit 74, a sample value storage unit 75, a fan driving time predicting unit 76, a conversion table 77, a cooling fan control unit 78, a motor driver 80, and a cooling fan 42. The cooling fan 42 has a motor 82 and a fan 84 rotated by the motor 82. The fixing control ratio detecting unit 74 detects a fixing control ratio K representing upon stoppage of printing, a ratio of time during which the fixing unit 28 was controlled to the printing temperature in a certain period of time in the past. The fixing control ratio K representing a ratio of time in a certain period of time in the past, during which the fixing unit was controlled to the printing temperature samples a control mode signal E2, at the timing of a clock signal E1, showing whether the current control is printing control or standby control, and stores the thus sampled value in the sample value storage unit 75. When assuming that the number of sample values sampled during a certain period of time in the past is N, sample values for a time a certain period of time prior by a time (T×N) from a period T of the clock signal E1 are stored in the sample value storage unit 75. The sample value storage unit 75 suffices therefore to be capable of storing N sample values: it stores sample values 1, 2, 3, . . . N, and for the (N+1) the sample value, it may return to the start to overwrite. The fixing control ratio detecting unit 74 determines the total number of sample values under printing control controlling the fixing unit to the printing temperature from among N sample values stored in the sample value storage unit 75, when stoppage of printing operation is detected from the control mode signal E2, that is, when the control mode signal E2 switched over from printing control to standby control. A fixing control ratio K is calculated by dividing the total number P of printing control sample values by the total number of samples N. More particularly, the fixing control ratio K is given by the following formula:

$$K=P/N$$

The fan driving time predicting unit 76 determines a predicted value of fan driving time after stoppage of printing with reference to the conversion table 77 base on the ratio K detected by the fixing control ratio detecting unit 74. The conversion table 77 has contents, for example, as shown in FIG. 5A. The conversion table 77 stores values of fan driving time Tf upon stoppage of printing corresponding to values of fixing control ratio K. Values of fixing control ratio K are divided into four levels of 0%, 25%, 50%, 75% and 100%, and for each of these levels of ratio, values of fan driving time Tf0, Tf1, Tf2 and Tf3 unique to the individual levels are stored. Setting is made so that the value of fan driving time Tf corresponding to the fixing control ratio K is longer after stoppage of printing when the fixing control ratio K is larger, and for a smaller fixing control ratio, becomes shorter. The conversion table 77 stores values of fan driving time Tf such as 2.5, 5, 7.5 and 10.0 minutes substantially in a proportional relationship with the four levels 0, 25, 50, 75% and 100% as shown in FIG. 5B. The fan driving time Tf may of course be non-linear relative to the fixing control ratio, or may be registered in a plurality of levels more or less than the four levels as shown in FIGS. 5A and 5B, or even as linear continuous parameters.

Referring again to FIG. 4, the fan driving time Tf determined from the current detecting ratio K with reference to the conversion table 77 in the fan driving time predicting unit 76 is set in the cooling fan control unit 78. When the control mode signal E2 indicates printing control, the cooling fan control unit 78 drives a motor 82 by means of a motor driver 80 to rotation-control the cooling fan 42. Upon stoppage of printing, the control mode signal E2 is switched over from printing control to standby control. In the conventional apparatus, the cooling fan control unit 78 stops the cooling fan 42 when printing control is switched over to standby control. In the invention, in contrast, even when the control mode signal E2 is switched over from printing control to standby control as a result of stoppage of printing, the cooling fan control unit 78 does not stop the cooling fan 42, but maintains the same control status as the fan control status during printing, i.e., the driving status of the cooling fan 42 for period of fan driving time Tf set by the fan driving time predicting unit 76 along with stoppage of printing operation, and stops the cooling fan 42 at a timing when a fan driving time Tf has elapsed after stoppage of printing.

FIGS. 6A to 6D are time charts of cooling control in the embodiment shown in FIG. 4. FIG. 6A represents fixing control for controlling temperature of the fixing unit 28: a printing temperature of, for example, 150° C. and a standby temperature of 120° C. are set as thermistor temperatures on the ordinate. FIG. 6B illustrates control mode as given by the control mode signal E2 shown in FIG. 4: standby control corresponding to stoppage of printing is expressed by a logical level of 0, and printing control for printing, by a logical level 1. FIG. 6C shows storage values sampled in synchronization with the clock signal E1 at the fixing control ratio detecting unit 74 shown in FIG. 4: for every prescribed sampling period Ts, states of control modes shown in FIG. 6B, i.e., logical levels 1s for printing control and logical levels 0s for standby control are incorporated as sample storage values, and N sample storage values giving a certain period of time in the past are always retained. FIG. 6D illustrates the fan control status by the cooling fan control 45 shown in FIG. 4, power supply of the printer unit, the control mode is first switched to standby control as until time t1 in FIG. 6A, and fixing control performs control so as to keep the thermistor temperature at the standby temperature. Simultaneously with this, the status of the control mode for every sampling period Ts is stored as a sample storage value, and at this point, sample storage values 0s representing standby control are retained in succession until time point t1. Assume that printing operation is started at time point t1 by switching over the control mode to printing control. In response to the start of printing operation, fixing control heating-controls the heater so as to bring the thermistor temperature to the printing temperature. Along with this, the thermistor temperature increases and is stabilized at the printing temperature of 150° C., and the record is printed by the electrophotographic apparatus in this state. At time point t2, printing control returns to standby control, and printing operation comes to an end at this point. When the printing operation is discontinued at time point t2, the number P of sample storage values of printing control is determined for a certain period of time in the past, for N sample storage values as counted from the printing end point of time T2. In this case, the total number of samples N during the certain period of time in the past is N=15. This leads to a number P of sample storage values at a logical level 1 for printing during this period of time is P=5. The fixing control ratio K at this point would therefore be:

$$K=5/15\times100=33(\%)$$

A fan driving time Tf1 is available by referring to the conversion table 77 shown in FIG. 5A. The cooling fan is therefore controlled continuously during the fan driving time Tf1 determined on the basis of the fixing control ratio K from the printing end time point t2, and upon elapse of the fan driving time Tf1, the fan control is discontinued. In FIGS. 6A to 6D, this is followed by start of printing at time point t3, end of printing at time point t4, another start of printing at time point t5 and another end of printing at time point t6. When printing comes to an end at time point t4, the fixing control ratio K would be:

$$K=10/15\times100=(66\%)$$

As a result, the fan driving time from the end of printing at time point t4 would be Tf2 as derived from the conversion table 77 shown in FIG. 5A, and Tf2=7.5 minutes is determined, for example, from FIG. 5B. Further, at the end of printing at time point T6, the fixing control ratio K at the point would be as follows:

$$K=12/15\times100=80(\%)$$

In this case, a fan driving time Tf3 is derived from FIG. 5A, this would take a value of Tf3=10.0 minutes, for example, from FIG. 5B. At the ends of printing at time points t2, t4 and T6 of FIGS. 6A to 6D, as described above, the fixing control ratio gradually increases from 33% to 66% and then to 80%. In response to this increase in the ratio, the operating time of the cooling fan after the end of printing is increased from Tf1 to Tf2 and then to Tf3, or more specifically, from 5.0 minutes to 7.5 minutes and then to 10.0 minutes so as to take a longer period of time for fan operation to inhibit the increase in machine internal temperature after stoppage of printing when the period of time during which the fixing unit 28 is controlled to the printing temperature of 150° C. is longer. While the sampling period T shown in FIG. 6 is larger than in an actual case for easy explanation, the actual sampling period Ts is of the order to milli-seconds or seconds, there is provided a sufficient time resolution.

Figure 7:
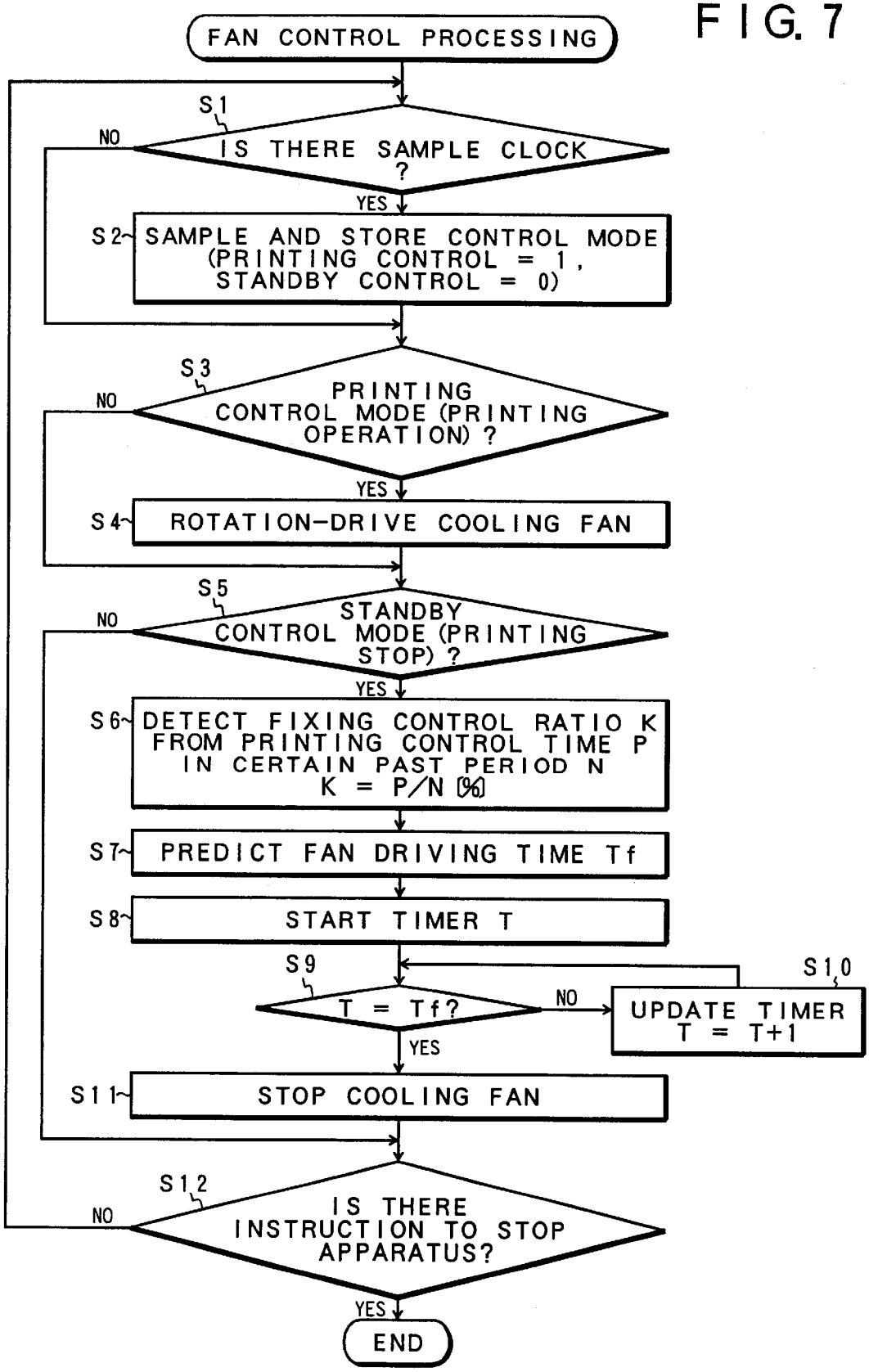
FIG. 7 is a flowchart of the cooling control processing of the invention rotating/stopping the cooling fan.

FIG. 7 is a flowchart of the cooling fan control operation in the embodiment shown in FIG. 4. First in step S1, it is checked up the presence or absence of a sample clock by input of a clock signal E1. If there is present a sample clock, the process proceeds to step S2, where the then current control mode is sampled and stored in the sample value storage unit. In this case, a 1 is stored if the mode is printing control, and a 0, if it is standby control. Then in step S3, it is determined whether or not the mode is printing control, and when the result is the printing control mode, i.e., indicates start of printing, the process proceeds to step S4 to rotation-control the cooling fan. Then in step S5, it is checked up whether or to the mode is standby control, i.e., it indicates stoppage of printing. When, in the state of printing control mode, stoppage of printing is determined by the standby control mode in step S5, a fixing control ratio K is detected from the number of printing control times P in the number of samples N during a certain period of time in the past on the basis of the sample values stored in the sample storage unit. Then in step S7, a fan driving time Tf after stoppage of printing is predicted with reference to the conversion table made by the detected fixing control ratio K. Then in step S8, a timer T is started, and time update of step S10 is repeated until the fan driving time Tf is reached by the timer T in step S9. When the timer T agrees with the fan driving time Tf in step S9, the cooling fan operation is discontinued in step S11. These steps S1 S11 are repeated until the printer unit issues a unit stop instruction in step S12.

Figure 8:
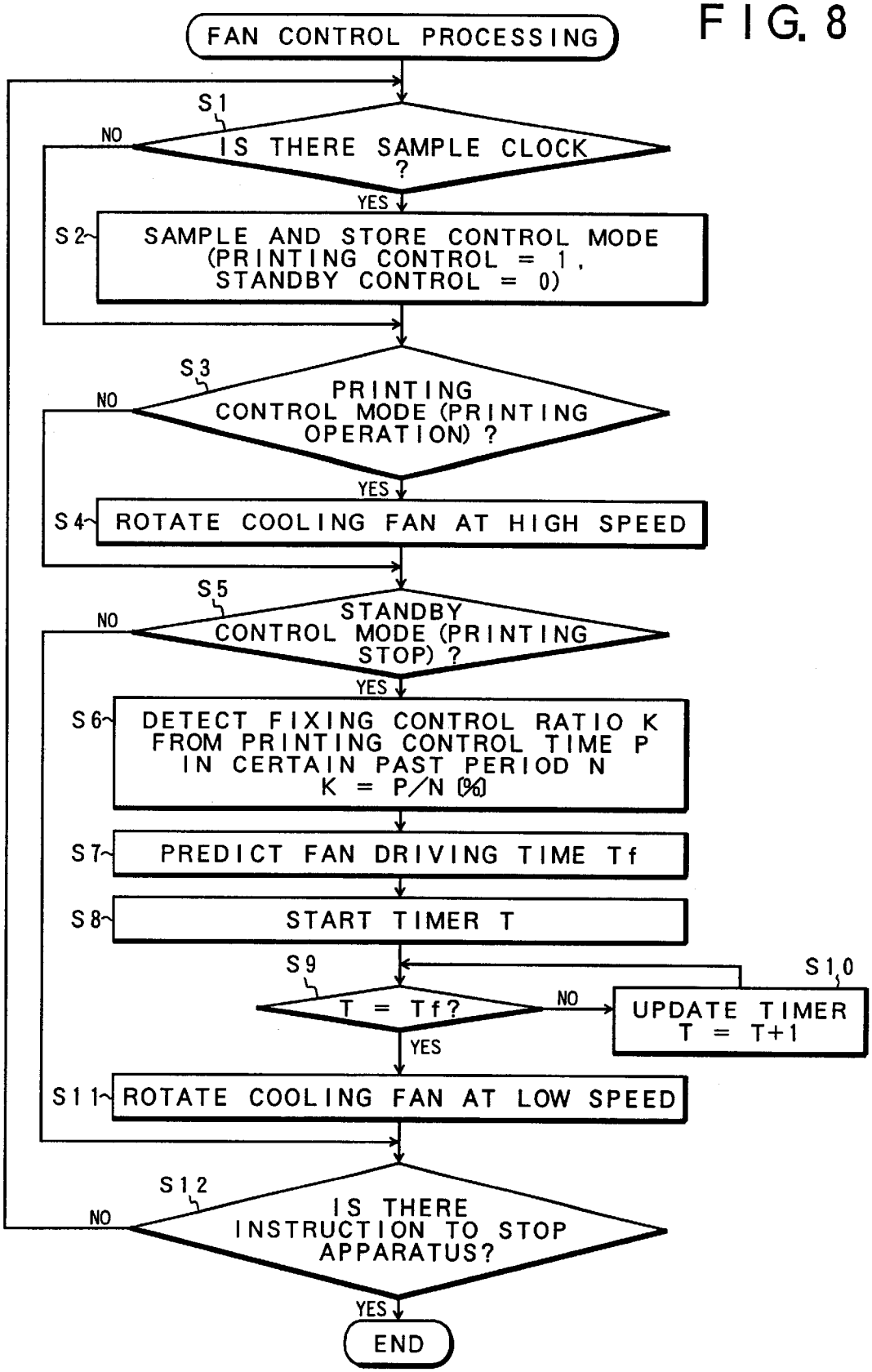
FIG. 8 is a flowchart of the cooling control processing in which the cooling fan is switched over between high-speed rotation and low-speed rotation.

FIG. 8 is a flowchart illustrating another embodiment of fan control of the invention. This embodiment is characterized in that the cooling fan is controlled to high-speed rotation during printing, and in the standby state after stoppage of printing, the cooling fan is switched over to low-speed rotation. The present embodiment differs therefore from that shown in FIG. 7 in that the cooling fan is controlled to high-speed rotation upon starting the printing operation in step S4, and that the cooling fan having maintained high-speed rotation after stoppage of printing in step S11 as in printing control is switched over to low-speed rotation at the point when the fan driving time Tf predicted on the basis of the fixing control ratio K during a certain period of time from the stoppage of printing has elapsed. Other steps are the same as in FIG. 7.

According to the present invention, as described above, the machine internal temperature is predicted on the basis of the ratio of time in a fixing temperature control state for a certain period of time in the past in which the fixing unit was controlled to the printing temperature; an increase in the machine internal temperature during stoppage of printing without the use of a temperature sensor such as a thermistor detecting the machine internal temperature by determining a stop timing through prediction of the fan driving time upon stoppage of printing on the basis thereof; the fan driving time after stoppage of printing can be minimized by determining the driving time after stoppage of printing of the fan under the detected condition; and it is accordingly possible to reduce noise of the cooling fan and power consumption.

Cooling fan control of an electrophotographic apparatus serving as a full-color printer has been described in the aforementioned embodiments. The invention is not however limited to these embodiments, but is directly applicable also to a printer unit as an electrophotographic apparatus capable of coping with monochromatic image forming. The invention includes appropriate variants within a range not impairing the object and advantages, and is not limited by the numerical values shown in the aforementioned embodiments.

What is claimed is:

1. A cooling control unit of an electrophotographic apparatus comprising:

a fixing unit, of which the temperature is controlled to a prescribed printing temperature by a heater during printing to fix toner to a sheet of paper, and controlled to a prescribed standby temperature during stoppage;

a cooling fan rotation-controlled to prevent increase in the machine internal temperature;

a ratio detecting unit which detects during stoppage of printing, a fixing control ratio representing a ratio of time during which said fixing unit is controlled to the printing temperature for a certain period of time in the past;

a predicting unit which predicts a fan driving time after stoppage of printing in response to said fixing control ratio; and a cooling fan control unit which rotation-controls a cooling fan during printing, and upon stoppage of printing, keeps a fan control status of printing during said predicted period of time.

2. An apparatus according to claim 1, wherein said predicting unit predicts a fan driving time after stoppage of printing increasing substantially in proportion to the fixing control ratio K.

3. An apparatus according to claim 1, wherein said cooling fan control unit rotates the cooling fan at a prescribed speed, and upon stoppage of printing, stops the cooling fan after rotating the same for said predicted time.

4. An apparatus according to claim 1, wherein said cooling fan control unit rotates the cooling fan at a high speed during printing, and upon stoppage of printing, keeps high-speed rotation of the cooling fan for said predicted time and then the rotation is switched over to low-speed rotation.

5. A cooling control method of an electrophotogaphic apparatus having a fixing unit, of which the temperature is controlled by a heater to a prescribed printing temperature during printing to fix toner on a sheet of paper, and upon stoppage of printing, controlled to a prescribed standby temperature, and a cooling fan rotation-controlled to prevent increase in the machine internal temperature; said method comprising the steps of:

detecting, during stoppage of printing, fixing control ratio representing a ratio of time during which the fixing unit is controlled to a printing temperature in a certain period of time in the past;

predicting a fan driving time after stoppage of printing in response to said fixing control ratio; and rotation-controlling the cooling fan during printing, and upon stoppage of printing, keeping a fan control status for printing during said predicted time.

6. A method according to claim 5, wherein the method further comprises the step of predicting a fan driving time after stoppage of printing increasing substantially in proportion to the fixing control ratio K.

7. A method according to claim 5, wherein the cooling fan is rotated at a prescribed speed during printing, and upon stoppage of printing, is stopped after rotation for said predicted time.

8. A method according to claim 5, wherein the cooling fan is rotated at a high speed during printing, and upon stoppage of printing, high-speed rotation of said cooling fan is kept for said predicted time and then switched over to a low-speed rotation.

* * * * *